United States Patent [19]

Tamba et al.

[11] Patent Number: 4,549,520

[45] Date of Patent: Oct. 29, 1985

[54] BREATHING DEVICE FOR FOUR STROKE ENGINE

[75] Inventors: Shinichi Tamba, Kakogawa; Takashi Mitadera, Akashi, both of Japan

[73] Assignee: Kawasaki Jukogyo Kabushiki Kaisha, Japan

[21] Appl. No.: 635,242

[22] Filed: Jul. 27, 1984

[30] Foreign Application Priority Data

Aug. 3, 1983 [JP] Japan ..... 58-121749[U]

[51] Int. Cl.[4] ..... F01M 13/00

[52] U.S. Cl. ..... 123/572; 123/573

[58] Field of Search ..... 123/572, 573, 574, 196 R, 123/195 C, 41.86

[56] References Cited

U.S. PATENT DOCUMENTS

| | | | |
|---|---|---|---|
| 1,244,321 | 10/1917 | Goodwin | 123/572 |
| 1,323,048 | 11/1919 | Goodwin | 123/572 |
| 1,944,341 | 1/1934 | Guse | 123/41.86 |
| 2,493,617 | 1/1950 | Chubbuch | 123/573 |
| 2,797,674 | 7/1957 | Dolza | 123/572 |
| 3,225,753 | 12/1965 | Bintz | 123/574 |
| 4,102,314 | 7/1978 | Sarto | 123/572 |
| 4,103,650 | 8/1978 | Nishida | 123/41.86 |
| 4,169,432 | 10/1979 | White | 123/41.86 |

*Primary Examiner*—Ronald H. Lazarus

[57] ABSTRACT

The breathing device for the 4 stroke engine includes a first separating chamber formed as a tappet chamber and a second separating chamber provided above a crank case. The second separating chamber is arranged above the first separating chamber. The crank chamber and the first separating chamber are communicated to each other by a first oil return port and a first vent arranged above the first oil return port. The first separating chamber and the second separating chamber are communicated to each other by a check valve. The second separating chamber and the crank case are communicated to each other by a second oil return port.

3 Claims, 6 Drawing Figures

BREATHING DEVICE FOR FOUR STROKE ENGINE

FIELD OF THE INVENTION

This invention relates to a breathing device for 4 stroke engine, which controls a pressure in a crank case through a tappet chamber.

DESCRIPTION OF THE PRIOR ART

In the 4 stroke engine the pressure in the crank case is so controlled by the breathing device that the mean pressure is held in minus value, in order to prevent a leakage of oil and to return a lubricating oil pooled in a circulating path to the crank case.

Figure 1:
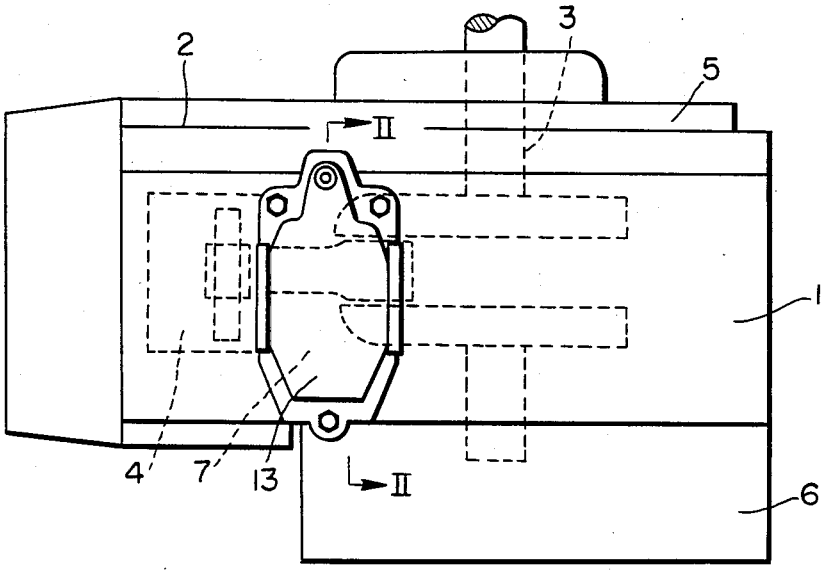
FIG. 1 is a side view of the 4 stroke engine of the prior art.

FIG. 1 shows a schematic side view of a vertical 4 stroke engine of the prior art. In this drawing 1 shows a crank case, 2 shows a cylinder, 3 shows a crank shaft, 4 shows a piston, 5 shows a crank case cover and 6 shows a oil pan.

Figure 2:
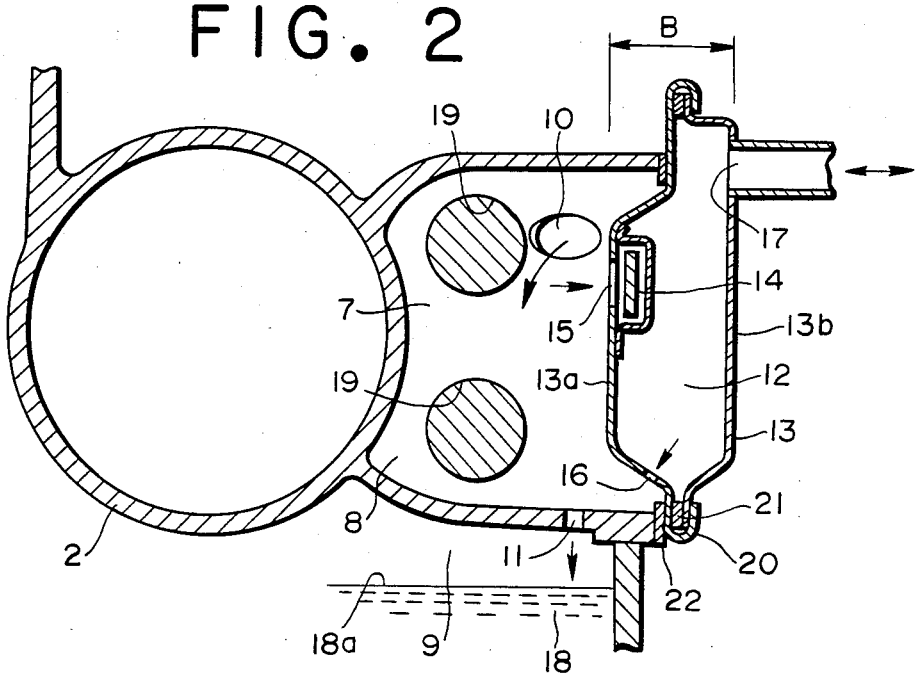
FIG. 2 is a enlarged sectional view taken along the line II—II of FIG. 1.

As shown in FIG. 2 a tappet chamber 7 is provided at a side of the cypinder 2. The tappet chamber 7 is used as a first separating chamber, in which the oil is separated from the air. A first vent 10 and a first oil return port 11 are provided between the tappet chamber 7 and a crank chamber 9. A side opening of the first separating chamber 8 is closed by a housing 13 providing a second separating chamber 12, in which the oil is separated from the air. The first separating chamber 8 is communicated with the second separating chamber 12 by a second vent 15, which is formed on a wall 13*a* between the first and the second separating chambers and is opened and closed by a check valve 14. A second oil return port 16 is formed on a lower portion of the wall 13*a* between the first and the second separating chambers 7 and 12. The second separating chamber 12 has a third vent 17 communicated with an air filter (not shown).

When the piston 4 is moved toward a bottom dead point (to the right hand in FIG. 1), the air pressure in the crank chamber 9 is increased, and the check valve 14 is opened. Therefore the first separating chamber 8 is communicated with the second separating chamber 12. The air in the crank chamber 9 flows into the first separating chamber 8 through the first vent 10 and then it flows into the second separating chamber 12 through the second vent 15.

When the piston is moved toward a top dead point, the air pressure in the crank chamber is decreased and the check valve 14 is closed. Therefore the oil separated in the second separating chamber and the air from the atmosphere flow into the crank chamber 9 only through the second oil return port 16 having a small sectional area.

On this construction the mean pressure in the crank chamber 9 can be held in the negative pressure during the operation of the engine by permitting the air to flow out freely from the crank chamber 9 and suppressing the air to flow into the crank chamber 9 from the atmosphere.

When the air flows out from the crank chamber 9 particles of the lubricating oil 18 collected in the crank chamber 9 are included in the air. The oil particles included in the air are separated from the air in the first separating chamber 8 and the second separating chamber 12 by changing the flow direction successively during a flow through the first separating chamber, the second chamber 12 and the third vent 17. The oil particles separated from the air remain in the first separating chamber 8 and the second separating chamber 12 and they return to the crank chamber 9 through the oil return ports 11 and 16. The oil particles flowing from the second separating chamber 12 to the third vent 17 are suctioned into the engine through the air intake path (not shown) and are burned.

As shown in FIG. 2 the tappet chamber 7 or the first separating chamber 8 in a vertical engine is arranged so in low position that it is close to a oil level 18*a* in the crank chamber 9. As in a wall of the first separating chamber 8 openings 19 for tappet shafts are provided, scattering and going into the first separating chamber from the crank chamber 9 of the oil particles can not be avoided. The oil particles going into the first separating chamber 8 are stirred with a valve spring (not shown) and they are scattered. In the construction having the second separating chamber 12 arranged at a side of the first separating chamber 8 a great volume of the oil in the first separating chamber 8 goes into the second separating chamber 12 through the check valve, which is always opened and closed, in case of tilting the engine, so that the volume of the oil flowing into the engine through the air intake path (not shown) is extremely increased. In this case white smoke which causes an atmosphere pollution is exhausted from the engine, and the oil consumption is increased. It is necessary to replenish the oil repeatedly.

By arranging side by side of the second separating chamber 12 and the first separating chamber 8, a depth size B of the second separating chamber can not be made in a large size, because the size of the engine is limited. Therefore the volume of the second separating chamber 12 is not enough for separating the oil from the air, and the producing of the white smog and the increasing of the oil consumption is encouraged.

The housing 13 of the second separating chamber 12 is formed by pressing two sheets of plate 13*a* and 13*b*. Two sheets of plate 13*a* and 13*b* have bent portions and a calking portion 20, so that it is difficult to obtain an accurate flatness at a connecting portion 21 between the both plates 13*a* and 13*b* and at a connecting portion 22 between the wall of the first separating chamber 8 and the plate 13*a*. Therefore the connecting portions 21 and 22 can not be sealed easily and many times are requested for producing the device and the work efficiency is decreased.

Such breathing device of the prior art is known in U.S. Pat. No. 2,693,789 (particularly in FIG. 3).

SUMMARY OF THE INVENTION

This invention has been developed for the purpose of obviating the aforesaid disadvantages of the prior art. Accordingly, the invention has as an object the provision of an improved breathing device for the 4 stroke engine of the type in which going into the second separating chamber from the first separating chamber of the oil is prevented, a faculty for separating the oil from the air in the second separating chamber is increased, producing of the white smog and the oil consumption are suppressed and the work time is reduced.

To accomplish the aforesaid object, there is provided the first separating chamber formed as a tappet chamber, the second separating chamber arranged on the first separating chamber in the vertical shaft type engine, the first oil return port provided at the bottom of the first separating chamber for returning oil to the crank chamber, the second oil return port provided at the bottom of the second separating chamber for returning oil to the crank chamber, the first vent provided above the first oil return port for communicating the crank chamber with the first separating chamber, the second vent communicating an upper portion of the first separating chamber with a bottom of the second separating chamber, the check valve arranged in the second vent, which allows the air to flow only from the first separating chamber to the second chamber, and the third vent provided in the second separating chamber above the second oil return port.

According to the invention, the second separating chamber in the vertical shaft type engine is positioned above the first separating chamber, so that it is difficult for the oil in the first separating chamber to go into the second separating chamber, even if the oil in the first separating chamber is scattered, and the engine is inclined. There is a enough space above the first separating chamber, so that the second separating chamber with a large volume can be formed and the enough capacity for separating the oil from the air can be obtained. Therefore the oil consumption in the crank chamber can be decreased. When the oil particles flowing through the second separating chamber are burned in the engine, the exhaust of the white smog from the engine can be suppressed by connecting the air cleaner with the second separating chamber.

According to the invention the second separating chamber can be formed integral with the first separating chamber and the crank chamber by using a die casting method. The shapes of the covers closing the openings of the first and second separating chambers are simple and the complicated work, for example calking etc., is not necessary, and further the opening can be easy sealed. According to the invention many man hours are not required, and the work efficiency can be increased.

DESCRIPTION OF THE PREFERRED EMBODIMENTS

Preferred embodiments of the invention will now be described in detail by referring to the accompanying drawings.

Figure 3:
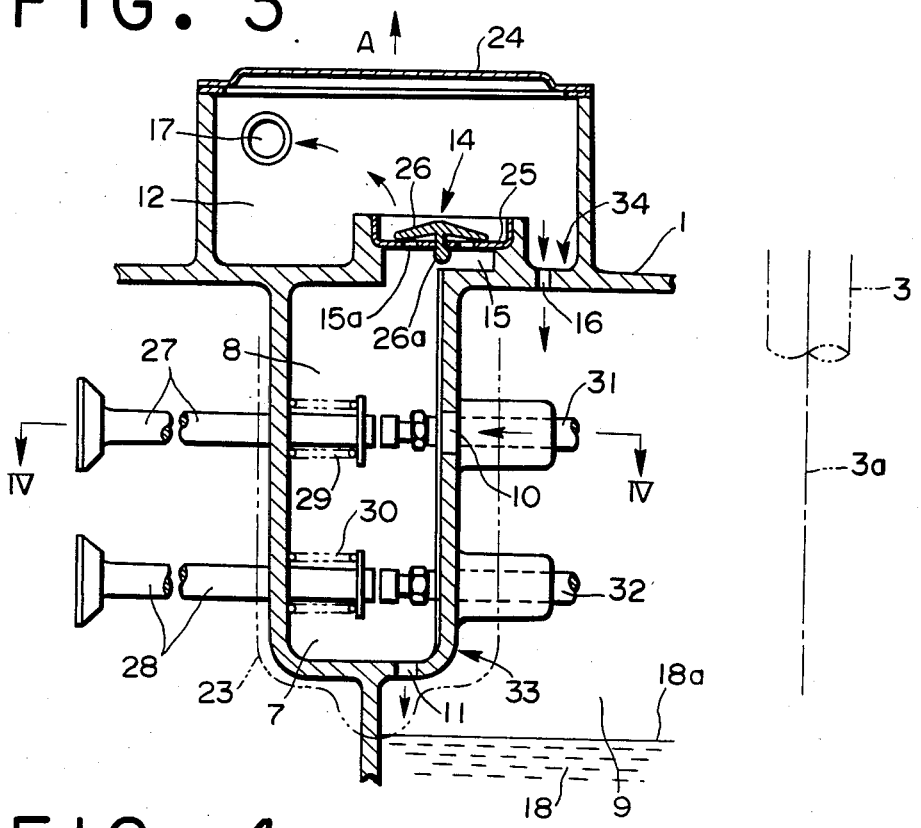
FIG. 3 is a vertical sectional view of the breathing device for the 4 stroke engine comprising one embodiment of the invention.
Figure 4:
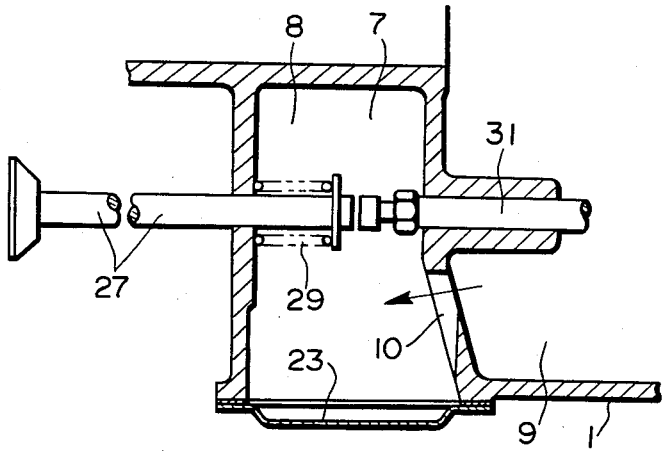
FIG. 4 is a sectional view taken along the line IV—IV of FIG. 3.

Referring to FIG. 3, there is shown in a fragmentary front view one embodiment of the breathing device for the vertical shaft type 4 stroke engine. FIG. 4 is a sectional view along the line IV—IV in FIG. 3. In FIG. 3 a tappet chamber 7 formed at a side portion of a crank chamber 9 is used as a first separating chamber 8, in which the oil is separated from the air, similar as the prior art. A first oil return port 11 is provided in a bottom wall of the first separating chamber 8, for returning the oil to the crank chamber 9. A first vent 10 is provided in a side wall of the first separating chamber 8 for flowing the air from the crank chamber 9. Above the first separating chamber 8 a second separating chamber is arranged, and it is formed integrally with the first separating chamber 8 and the crank chamber 9 by using the die casting method, A second vent 15, which is opened and closed by a check valve 14, is provided on a wall partitioning into an upper surface of the first separating chamber 8 and the bottom of the second separating chamber 12. At a high position of a side wall of the second separating chamber 12 a third vent 17 communicating with a inlet path (not shown) is provided. At the bottom of the second separating chamber 12 a second oil return port 16 having a sectional area smaller than the third vent 17 is provided. A side opening of the first separating chamber 8 is closed by a cover 23 (FIG. 4), and an upper opening of the second separating chamber 12 is closed by a cover 24.

The check valve 14 allows the air to flow only from the first separating chamber 9 to the second separating chamber 12. The check valve 14 is formed with a valve seat 25 pressed into and secured to the bottom wall of the second separating chamber 12 and a mushroom type valve 26 which is flexible. An under portion of a central axis 26*a* of the valve 26 is inserted and engaged with a valve sheet 25. In the valve sheet 25 holes 15*a* of the second vent 15 are provided.

In FIGS. 3 and 4,27 designates a inlet valve, 28 designates a exhaust valve, 29 and 30 designate valve springs and 31 and 32 designate tappets.

Other parts is similar to that explained in FIGS. 1 and 2.

When the air pressure in the crank chamber 9 is increased by the motion of the piston in the construction according to the invention as similar as in the prior art, the air flows into the first separating chamber 8 through the first vent 10 with a comparatively large opening and then the air quickly acts on the mushroom type valve 26 of the check valve 14 in the second vent 15 and pushes up the peripheral portions thereof, and then flows into the second separating chamber 12. As the second separating chamber 12 is connected to the air cleaner (not shown) through the third vent 17 with a comparatively large opening, the air in the crank chamber 9 can flow into the air cleaner rapidly.

When the air pressure in the crank chamber 9 is decreased by the piston motion, the valve 26 of the check valve 14 comes back to the initial situation elastically rapidly, and the second vent 15 is momently closed. Therefore the air is sucked into the crank chamber 9 with the oil separated from the air in the second separating chamber only through the second oil return port 16. As the second oil return port 16 is smaller than the third vent 17, the volume of the air sucked into the crank chamber is little. Therefore the pressure in the crank chamber 9 can be held in the negative.

In this embodiment, the mean pressure in the crank chamber 9 can be held in the negative pressure because of the exhaust of the air from the crank chamber 9 and the suppression of the suction of the air into the crank chamber 9.

The oil particles contained in the air exhausted from the crank chamber 9 remain partially in the first separating chamber 8 and the second separating chamber 12, as the flow direction of the air from the crank chamber 9 is changed successively in a flow course through the first separating chamber, the second separating chamber and the third vent 17, the motion of the oil particles are calmed in the large separating chamber and they contact obstacles, for example valve springs 29, 30 etc. The oil particles remaining in the separating chamber return to the crank chamber 9 through the oil return ports 11 and 16. A little of the oil particles flowing into the third vent 17 from the second separating chamber 12 go into the engine through the air filter (not shown) and burned.

As the second separating chamber 12 is positioned on the first separating chamber 8 and positioned apart from the oil level 18*a* in the crank chamber 9, the oil particles scattered and going into the first separating chamber 8 from the crank chamber 9 in the engine operating flow scarcely into the second selecting chamber through the check valve, even if the oil particles are scattered by the valve springs in the first separating chamber again and the engine is inclined. As the second oil return port 16 is positioned on the upper surface of the crank chamber 9 and the sectional area thereof is comparatively small, it is almost impossible, that the oil particles scattered in the crank chamber 9 go into the second separating chamber 12 through the second oil return port 16. Therefore the consumption of the oil which is sucked from the second separating chamber into the engine through the air filter and burned in the engine is decreased, so that the white smog exhausted from the engine is decreased.

As there is a enough space above the first separating chamber 8 formed as the tappet chamber 7 and a side of a main bearing having a comparatively large width, the second separating chamber 12 provided in this space, can be formed as a chamber with a larger volume, for decreasing the exhaust of the white smog and the oil consumption. The second separating chamber 12 is formed integral with the first separating chamber 8 and the crank chamber 9 by using the die casting method, and the covers 23 and 24 for closing the openings of the first and second separating chambers 8 and 12 can be formed simply, so that the openings of the selecting chambers can be sealed without using complicated work, for example calking etc. Therefore the device can be manufactured with few man hours and the working effect can be increased.

In FIG. 3 the first oil return port 11 and the second oil return port 16 are formed parallel with an axis 3*a* of the crank shaft 3. As axes of the both ports 11 and 16 are elongated along a rapping direction shown with arrow A of the crank case 1, the both ports 11 and 16 can be formed easily together with the crank case 1 by using die casting.

In the vertical shaft type engine shown in FIG. 3, if the first oil return port 11 and the second oil return port 16 are respectively positioned in the vicinity of corners 33 or 34 of the bottom of the separating chambers, the both oil return ports 11 and 16 can be positioned in the vicinity of the bottom of the separating chambers 8 and 12 in the case of the horizontal shaft type engine, which is formed by tilting the engine in FIG. 3 to the right side about 90°. Therefore the oil return port can be used effectively both in the vertical shaft type and in the horizontal shaft type engine.

Figure 5:
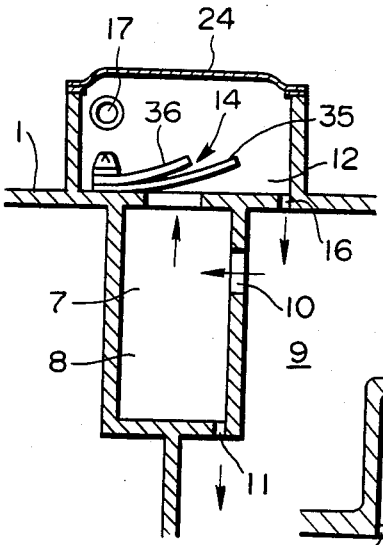
FIG. 5 is a sectional view of a check valve used in the breathing device of the invention in another embodiment.

As shown in FIG. 5 the check valve 14 can be formed as a lead valve including the valve element 35 formed with metal spring sheet and a stopper 36 for controlling the opening angle of the valve element 35.

Figure 6:
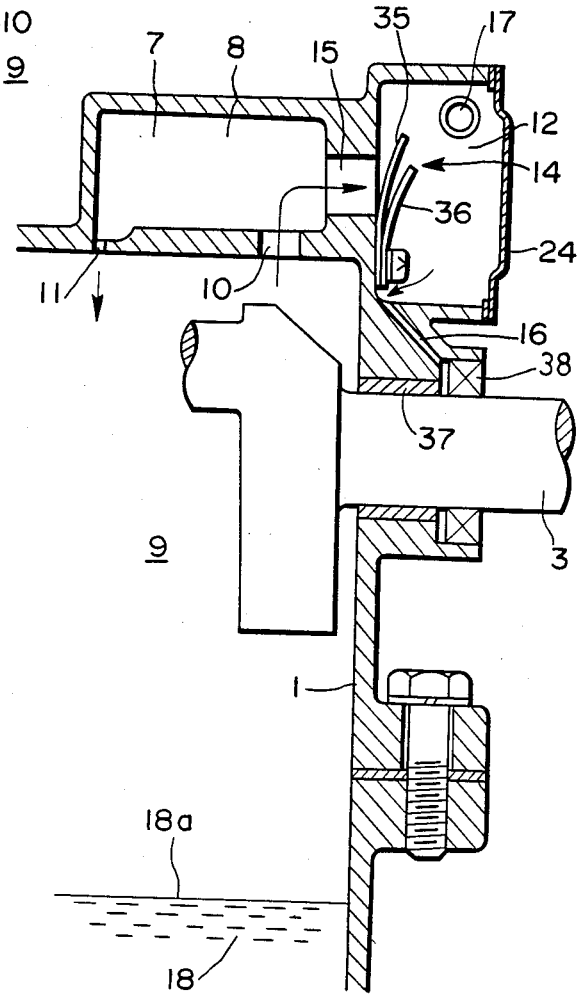
FIG. 6 is a sectional view showing a modification of a oil return port.

Refering to FIG. 6, there is shown one embodiment of the breathing device according to the invention used in the horizontal shaft type 4 stroke engine. In FIG. 6 the second separating chamber 12 is arranged at a side of the first separating chamber 8, but it is difficult, that the oil 18 in the crank chamber 9 goes into the first separating chamber 8 and the second separating chamber 12, as the oil level 18*a* in the crank chamber 9 is set at a considerably low position. Therefore it is not necessary to arrange the second separating chamber 12 above the first separating chamber. As the first vent is positioned at the bottom of the first separating chamber, it can be used as the first oil return port, so that it is not necessary to provide the first oil return port 11 separately.

In FIG. 6 the second oil return port 16 is formed as a canal elongated from the bottom of the second separating chamber 12 through a bearing surface 37 on one side of the crank shaft 3 to the crank chamber 9. The oil pooled in the second separating chamber 12 is returned to the crank chamber 9 through the bearing surface 37, at the time the oil lubricates the bearing surface 37. 38 designates an oil seal.

The second oil return port 16 in the vertical shaft type engine in FIG. 3 can be used for lubricating the bearing surface as in FIG. 6. As the second oil return port 16 is provided above the crank chamber 9 in FIG. 3, the lubrication of the upper bearing, which is compricated in the prior art, can be accomplished by a simple construction by using the second oil return port 16 for the lubrication of the bearing of the crank shaft. Such lubrication can be used for the bearing surface of the cam shaft.

What is claimed is:

1. In a 4 stroke engine wherein the improvement comprises a breathing device, said breathing device comprising a first separating chamber for separating oil from air, said first separating chamber being formed as a tappet chamber having openings for receiving tappet shafts, a crank chamber, a vertical crank shaft in the crank chamber, a bearing for said crank shaft, a second separating chamber for separating oil from air provided above said crank chamber and said second separating chamber being positioned at a side of the bearing of the crank shaft, a first oil return port provided in the bottom of the first separating chamber for communicating with the crank chamber, a second oil return port provided in the bottom of the second separating chamber for communicating with the crank chamber, a first vent provided for communicating the crank chamber with the first separating chamber, a second vent for communicating the first separating chamber with the second separating chamber, a check valve arranged in the second vent for allowing air to flow only from the first separating chamber to the second separating chamber, and a third vent positioned above the second oil return port in the second separating chamber.

2. In a 4 stroke engine wherein the improvement comprises a breathing device, said breathing device, comprising a first separating chamber for separating oil from air, said first separating chamber being formed as a tappet chamber having openings for receiving tappet shafts, a crank chamber, an elongated vertical crank shaft in the crank chamber, a bearing for said crank shaft, a second separating chamber for separating oil from air provided above the first separating chamber and said second separating chamber being positioned at a side of said bearing, a first oil return port provided in the bottom of the first separating chamber for communicating with the crank chamber, a second oil return port provided in the bottom of the second separating chamber for communicating with the crank chamber, a first vent provided above the first oil return port for communicating the crank chamber with the first separating chamber, a second vent for communicating an upper surface of the first separating chamber with the bottom of the second separating chamber, a check valve arranged in the second vent for allowing air to flow only from the first separating chamber to the second separating chamber, and a third vent positioned above the second oil return port in the second separating chamber.

3. Breathing device for the 4 stroke engine as claimed in claim 1 or 2, wherein the second oil return port is formed as a canal elongated from the second separating chamber to the crank chamber through a bearing surface of the crank shaft.

* * * * *